US005551357A

United States Patent [19]

Wu et al.

[11] Patent Number: 5,551,357

[45] Date of Patent: Sep. 3, 1996

[54] METHOD AND SYSTEM FOR RECYCLING SORBENT IN A FLUIDIZED BED COMBUSTOR

[75] Inventors: Song Wu, South Williamsport; Samuel G. Probst, Lock Haven; Christina M. Edvardsson, Montoursville; Michael G. Alliston, Lewsburg, all of Pa.

[73] Assignee: Tampella Power Corporation, Williamsport, Pa.

[21] Appl. No.: 293,471

[22] Filed: Aug. 19, 1994

[51] Int. Cl.[6] ..... F23J 3/00

[52] U.S. Cl. ..... 110/344; 110/266; 110/165 R

[58] Field of Search ..... 110/342, 344, 110/345, 245, 220, 222, 165 R, 259, 266; 423/243.1, 243.11

[56] References Cited

U.S. PATENT DOCUMENTS

| | | | |
|---|---|---|---|
| 4,185,080 | 1/1980 | Rechmeier . | |
| 4,312,280 | 1/1982 | Shearer . | |
| 4,387,078 | 6/1983 | Lin . | |
| 4,421,036 | 12/1983 | Brannstrom . | |
| 4,530,291 | 7/1982 | Wysk | 110/342 |
| 4,640,205 | 2/1987 | Brannstrom . | |
| 4,809,625 | 3/1989 | Garcia-Mallol . | |
| 4,872,423 | 10/1989 | Pillai . | |
| 4,920,751 | 5/1990 | Gounder . | |
| 5,163,374 | 4/1992 | Rehmat . | |
| 5,197,398 | 3/1993 | Levy et al. | 110/347 |
| 5,345,883 | 9/1994 | Panos | 110/345 |

OTHER PUBLICATIONS

Falkenberry, H. L. et al., "$SO_2$ Removal By Limestone Injection". *Chem Eng. Prog.* vol. 65, No. 12, pp. 61–66 (Dec. 1969).

Shearer, J. A. et al.., "Hydration Enhanced Sulfation of Limestone and Dolomite in The Fluidized–Bed Combustion of Coal" *J. Air Poll. Cont. Assoc.*, vol. 30, No. 6, pp. 684–688 (Jun. 1980).

Edvardsson, C. M. et al., "Thermogravimetric Analysis of Limestones for Prediction of Utilization in CFB Combustors". Presented at Environmental Aspects of Cogeneration Conference, Nov. 10–12, 1992, Pittsburgh, Pennsylvania.

*Primary Examiner*—Henry A. Bennet
*Assistant Examiner*—Susanne C. Tinker
*Attorney, Agent, or Firm*—Stephen Donovan

[57] ABSTRACT

A method and system for recycling a sulfur sorbent present in the combustion residue of a circulating, fluidized bed, fossil-fuel combustor is disclosed. The method can comprise the steps of, adding water to the combustion residue, classifying the combustion residue into a fuel ash portion and a hydrated sorbent portion, and returning the hydrated sorbent portion to the circulating, fluidized bed, fossil-fuel combustor.

35 Claims, 4 Drawing Sheets

METHOD AND SYSTEM FOR RECYCLING SORBENT IN A FLUIDIZED BED COMBUSTOR

BACKGROUND

The present invention relates to a method and system for reducing a power plant's sulfur emissions. In particular, the present invention relates to a method and system for recycling an increased sulfation capacity sorbent in a fluidized bed fossil-fuel combustor.

Electricity for residential, commercial and industrial use can be produced by combusting a fossil fuel in a furnace to generate high pressure steam. The steam can be allowed to expand in a turbine which will rotate and generate electrical power. By-products of burning a fossil fuel, such as coal, can include a combustion residue and flue gas. The combustion residue is largely fuel ash comprised of various inorganic substances, including silicon, aluminum, titanium, ferric, calcium and potassium oxides. The combustion residue can also include uncombusted fuel, and sorbent particles. The flue gas can contain large amounts of sulfur dioxide, unchecked release of which can have adverse environmental effects.

A sorbent, such as an alkaline earth oxide, can be used to remove significant amounts of the sulfur dioxide present in the flue gas by absorbing and retaining the sulfur dioxide in a solid sulfate form.

Fluidized bed combustion has distinct advantages for burning solid fuels and recovering energy to produce steam. In a circulating fluidized bed combustion system, fuel particles, typically crushed coal, are suspended in an upwardly flowing gas stream in a furnace. The fuel-gas combination can exhibit fluid-like properties. At an appropriate location, solids can be collected by a particle separator and circulated back to the furnace.

The solid fuel used to fire a fluidized-bed combustor can comprise non-fossil waste or fossil fuel derivatives. Typically, the solid fuel fed to a fluidized bed combustor is crushed coal mixed with a sulfur sorbent, such as limestone or dolomite particles. Use of a sorbent can permit 90% or more, depending upon the sulfur content of the fuel and the amount of sorbent added to the fluidized bed, of the sulfur dioxide released into the flue gas by fossil fuel combustion to be taken up by the sorbent.

Limestone, consisting largely of calcium carbonate, is a commonly used sulfur sorbent. Upon being fed into the fluidized bed of a combustor, the heat present can cause the limestone particles to undergo a calcination reaction to calcium oxide as follows:

$$CaCO_3 \xrightarrow{heat} CaO + CO_2 \quad (1)$$

After calcination and release of carbon dioxide, the sorbent particles become porous. The calcium oxide sorbent particles can absorb sulfur dioxide to form calcium sulfate:

$$CaO+SO_2+\tfrac{1}{2}O_2 \rightarrow CaSO_4 \quad (2)$$

The sorbent particles, with captured sulfur dioxide, remain in the combustion residue of the bed material.

Usually, only a fraction of the calcium oxide present in a typical sorbent particle reacts with and retains any sulfur dioxide. This is believed to be due to an initial rapid build up of calcium sulfate on the surface of the sorbent particle which blocks the pore structure of the sorbent particle. The interior bulk of the sorbent particle is thereby prevented from coming into contact with and absorbing sulfur dioxide.

Typically, a calcium to sulfur molar ratio of between about 1.5:1 to about 6:1 is required to capture about 90% of the sulfur released by combustion of fossil fuels in a fluidized bed reactor, depending on fuel and sorbent properties. Thus, about 40% to about 85% of the calcium oxide in a typical sorbent particle does not participate in any sulfur absorption.

Efforts have been made to increase sulfur sorbent utilization. Adding water to the combustion residue can hydrate the sorbent particles and increase the sulfation capacity of the sorbent particles by up to about 200%. When water is brought into contact with the combustion residue, hydration of the sorbent particles present in the combustion residue can take place as follows:

$$CaO+H_2O \rightarrow Ca(OH)_2 \quad (3)$$

Hydration can also cause the sorbent particle to swell and crack, thereby exposing additional surface area. Upon return of the combustion residue, including hydrated sorbent particles, to the fluidized bed of a fossil-fuel combustor, the sorbent particles can decompose to calcium oxide and water:

$$Ca(OH)_2 \xrightarrow{heat} CaO + H_2O \quad (4)$$

Significant additional amounts of calcium oxide are thereby exposed and made available to capture additional sulfur dioxide from the flue gas.

Because the spent sorbent particles are hydrated by contact with water, it is important to distribute the water as evenly as possible throughout the sorbent particles present in the combustion residue. Unfortunately, significant problems can arise when attempting to process the particulate combustion residue during and subsequent to treatment with water. Thus, a wet particulate matter tends to be cohesive and to lose its flow and fluidization properties. Additionally, combining sorbent with water can result in formation of a cement-like slurry. Furthermore, excess water can pool and interfere with combustion residue transport.

Previous attempts to address these problems by adding the water to the combustion residue in the form of a water/steam mixture have been unable to overcome the additional difficulties and restraints imposed due to the high temperature and pressure characteristics of steam.

Furthermore, although a mechanical or rotary hydrator can be used to reduce combustion residue aggregation as water is added to the combustion residue (to hydrate the sorbent particles present in the combustion residue), it is known that a mechanical hydrator can jam or otherwise malfunction due to the nature of the wet particulate matter present in the hydrator. Additionally, a mechanical hydrator can experience rapid abrasion of the parts in contact with the combustion residue and can therefore be expensive to operate and maintain.

A fluidized-bed hydrator can provide an even hydration fluid distribution to the spent sorbent particles present in the combustion residue, with a significant reduction of the aggregation and wear problems associated with use of a mechanical hydrator. U.S. Pat. No. 4,312,280, which is incorporated herein by reference in its entirety, discloses a fluidized bed hydrator for hydrating spent sorbent particles.

U.S. Pat. No. 4,313,280 discloses that subsequent to hydration, the combustion residue, including hydrated sorbent particles is returned to the combustor for further sulfur capture by the hydrated sorbent particles. Returning all the combustion residue to the combustor in this manner is inefficient because it is only the hydrated sorbent portion of the combustion residue for which there is any further use.

Unfortunately, there is no easy or practical way to separate hydrated sorbent particles from the rest of the combustion residue and to return only the hydrated sorbent particles to the fluidized bed combustor. Hence, the combustor ash load and the work of the ash handling equipment increases geometrically as each batch of combustion residue (with hydrated sorbent) is returned to the combustor from the hydrator. U.S. Pat. No. 4,312,280 addresses this problem by simply sending an unclassified portion of the combustion residue removed from the hydrator to waste. This is inefficient because a significant amount of the unclassified combustion residue sent to waste can include useful, hydrated sorbent particles. Hence, merely disposing an unclassified portion of the combustion residue to waste is inefficient and increases costs, as additional sorbent to replace that disposed of to waste must be obtained.

The practical inability to efficiently recycle sorbent particles in the fluidized bed of a fossil-fuel combustor can increase costs, reduce combustor life and create significant environmental hazards. For example, the cost of a sufficient amount of sorbent for a desired level of sulfur absorption is increased. Additionally, failure to efficiently recycle sorbent results in a larger amount of required sorbent. This in turn adds to the load of the combustion residue handling system, resulting in a greater auxiliary power outlay, more rapid equipment fatigue and failure and higher maintenance and replacement costs.

Furthermore, an excess of free lime sorbent particles in the combustor can result in increased levels of nitric oxide emission in the combustor flue gases. Excess free lime is also strongly alkaline and can therefore require that the combustion residue be neutralized for safe handling and to meet stringent disposal conditions and requirements imposed by various regulatory agencies.

Finally, an adverse environmental impact can result from the extensive quarrying for and disposal of the voluminous quantities of solid sorbent required when an efficient sorbent recycle is not carried out.

What is needed therefore is a method and system for efficiently recycling spent sulfur sorbent particles in a fluidized bed fossil-fuel combustor.

SUMMARY

The present invention satisfies this need and provides a simple, efficient, and economical method and system for recycling a sulfur sorbent in a fluidized bed fossil-fuel combustor.

A method and system according to the present invention provides a process and apparatus for hydrating, classifying and then reinjecting a portion of the combustion residue comprising principally sorbent particles back into the fluidized bed of a fossil-fuel combustor. The remainder of the combustion residue, comprising principally fuel ash, is discarded. Spent sorbent particles are thereby rejuvenated by hydration and efficiently recycled in the fluidized bed fossil-fuel combustor.

A preferred embodiment of the method can be carried out by first removing a combustion residue from the fluidized bed of the fossil-fuel combustor. Typically, the combustion residue can comprise sorbent particles and non-sorbent particles. The next step of the method is to transport the combustion residue to a hydrator. Once in the hydrator, the combustion residue is contacted with a hydration fluid to provide hydrated sorbent particles with an increased sulfation capacity. The hydration fluid is preferably water which is provided to the fluidized hydrator bed as water and steam in variable proportions. While in the fluidized bed of the hydrator, the sorbent particles can expand, crack and break up into smaller hydrated sorbent particles. Subsequently, the combustion residue, including hydrated sorbent particles, is conveyed to a classifier.

In the classifier, the combustion residue is classified into a portion comprising principally or substantially sorbent particles and a portion comprising principally non-sorbent particles. The non-sorbent particles are usually almost entirely fuel ash. Classification can be achieved because the hydrated sorbent particles are typically both smaller and lighter than the non-sorbent particles present in the combustion residue conveyed from the hydrator.

Preferably, the classified sorbent portion comprises not more than about 20% by weight non-sorbent particles. More preferably, the classified sorbent portion comprises not more than about 10% by weight non-sorbent particles. Most preferably, the classified sorbent portion comprises not more than about 5% by weight non-sorbent particles. In a particularly preferred embodiment of the present invention, only about 2.5% or less by weight of the classified sorbent portion comprises non-sorbent particles.

Preferably, of the sorbent particles present in the classified sorbent portion, at least about 80% have been hydrated, that is at least about 80% by weight of the CaO transported into the hydrator from the combustor has been converted into $Ca(OH)_2$ by the hydration step. More preferably, at least about 90% of the sorbent particles present in the classified sorbent portion have been hydrated. Most preferably, at least about 95% of the sorbent particles present in the classified sorbent portion have been hydrated. In a particularly preferred embodiment of the present invention, at least about 97% of the sorbent particles present in the classified sorbent portion have been hydrated.

The last step of the method is to return the sorbent particle portion to the fluidized bed of the fossil-fuel combustor. The sorbent particles are thereby recycled in the fluidized bed combustor.

The present invention also includes within its scope, a system for improving the sulfation capacity and use in a fossil-fuel combustor of sorbent particles. A preferred embodiment of the system can comprise apparatus for removing the combustion residue from the fossil-fuel combustor; an apparatus for adding water and/or steam to the combustion residue; an apparatus for classifying the combustion residue into a sorbent particle and a non-sorbent particle portion and an apparatus for returning the classified sorbent particle portion to the fossil-fuel combustor.

DRAWINGS

These and other features, aspects, and advantages of the present invention can become better understood from the following description, claims and the accompanying drawings where:

DESCRIPTION

Figure 1:
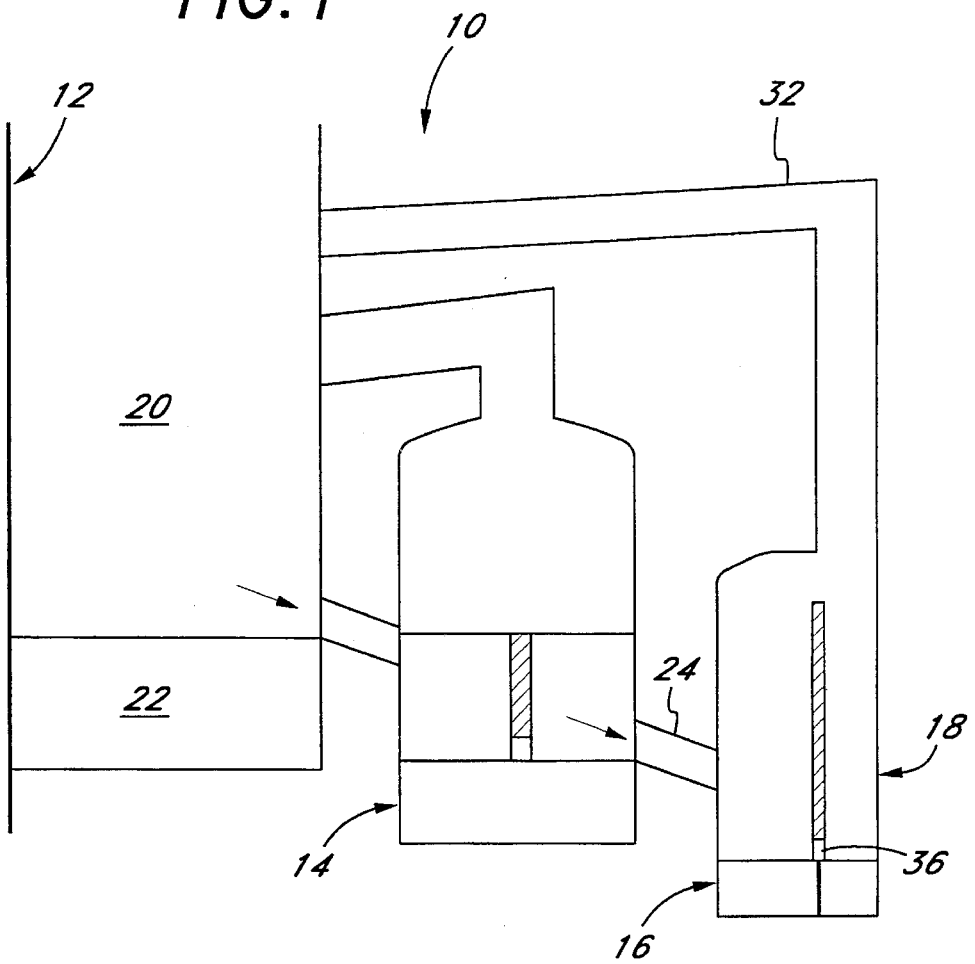
FIG. 1 is a schematic representation of a system within the scope of the present invention.

The present invention is based upon the finding that a combustion residue removed from a fluidized bed solid-fuel combustor can be contacted with water, classified into a hydrated sorbent portion and a non-sorbent portion, and the hydrated sorbent portion efficiently recycled to the combustor.

A key to the success of the disclosed method and system is a rapid and effective sorbent hydration in a fluidized bed hydrator followed by an efficient separation of sorbent from non-sorbent particles by a fluidized bed classifier.

In the fluidized-bed combustor, sorbent, such as limestone particles, can be calcined to calcium oxide. The calcium oxide can then react with the sulfur dioxide produced during the combustion of coal. This results in the formation of sorbent particles with an exterior coating of calcium sulfate overlaying a portion of the sorbent particle which remains in the form of calcium oxide. After the external sorbent particle calcium sulfate layer has been formed further contact with sulfur dioxide produces little, if any, subsequent capture of sulfur by the sorbent particle.

A method according to the present invention recycles used sorbent particles by removing the combustion residue from a fluidized bed fossil-fuel combustor and transporting the combustion residue to a fluidized bed hydrator. The combustion residue includes both sorbent particles and fuel ash particles. Once in the hydrator, the combustion residue is fluidized and contacted with water. Fluidization of the combustion residue present in the hydrator facilitates an even water distribution among the sorbent particles. Additionally, fluidization of the hydrator bed assists drying the combustion residue particles. The water and/or steam used to hydrate the sorbent particles causes the sorbent particles to swell and crack, thereby opening up more surface area for later sulfur absorption by the decrepitated sorbent particles.

While in the fluidized bed hydrator, essentially (i.e. 90%+) complete hydration of all the sorbent particles present in the combustion residue occurs.

An important aspect of the invention is our discovery that spent sorbent present in the fluidized bed of the combustion residue present in the hydrator can be hydrated with a water/steam mixture without resulting in particulates with a high surface moisture. High surface moisture particles are wet and sticky. The combustion residue particles resulting from our method have a low surface moisture, and therefore a low aggregation tendency. Processing of the combustion residue comprising hydrated sorbent, including conveying the combustion residue to the classifier, is therefore facilitated.

A low surface moisture combustion residue, including the hydrated sorbent particles, is achieved by a careful balancing of two countervailing conditions. Firstly, sufficient water (in the form of water and/or a water/steam mixture) must be added to the combustion residue present in the fluidized hydrator bed so as to hydrate substantially all the sorbent particles present in the combustion residue. The objective is to maximize the conversion of spent sorbent into sorbent capable of participating in further sulfur absorption, once the hydrated sorbent has been recycled back to the combustor.

Secondly, the average temperature of the sorbent particles present in the fluidized bed of the hydrator must be: (1) high enough to evaporate any excess moisture present on the surface of the hydrated sorbent particles, so as to obtain dry combustion residue particles. Generally dry particles are required so that the combustion residue can be fluidized at a suitable fluidizing gas stream velocity; and (2) low enough to permit the hydration reaction to rapidly proceed. This second condition requires that the bed temperature be sufficiently close to the steam condensation temperature in the environ of the sorbent particles.

From the fluidized bed hydrator, the combustion residue is conveyed to a fluidized bed classifier. The purpose of the classifier is to allow the return of mostly reclaimed (hydrated) sorbent back to the combustor while permitting mostly non-sorbent solids to be drained off. For this purpose, the classifier bed is maintained at a fluidizing velocity so that the sorbent particles can be separated from the generally larger fuel ash particles.

The fluidizing velocity of the classifier bed is such that the combustion residue is classified into a portion comprising principally all the hydrated sorbent particles and a portion comprising principally all the non-sorbent particles, which are primarily fuel ash particles. The hydrated sorbent particles are then returned to the fluidized bed fossil-fuel combustor for further sulfur dioxide absorption. The fuel ash particles can be sent to waste.

FIG. 1 is a schematic diagram of a system 10 for recycling sorbent within the scope of the present invention. The system 10 can include a fluidized bed fossil-fuel boiler or combustor 12, a bed ash cooler 14, a hydrator 16 and a classifier 18. Gravity flow and/or dense-phase pneumatic transport passageways can be used to interconnect these components of the system 10. The bed ash cooler 14 is often used when a high ash fuel such as anthracite culm or bituminous gob is burned in the combustor 12. Otherwise a bed ash cooler can be dispensed with, or replaced with an alternate solids cooling device such as a screw-cooler.

The combustor 12 has a combustion chamber 20 into which a bed of combustible material such as crushed coal, noncombustible material such as a crushed sorbent, primary air and secondary air are fed. The combustion chamber 20 is provided with a bottom 22 which has a grid-like construction through which air can be introduced. The air introduced through the bottom 22 of the combustor 12 produces a fluidized bed and provides a source of oxygen for combustion of the coal. Flue gases can exit from the top of the combustor.

Figure 2:
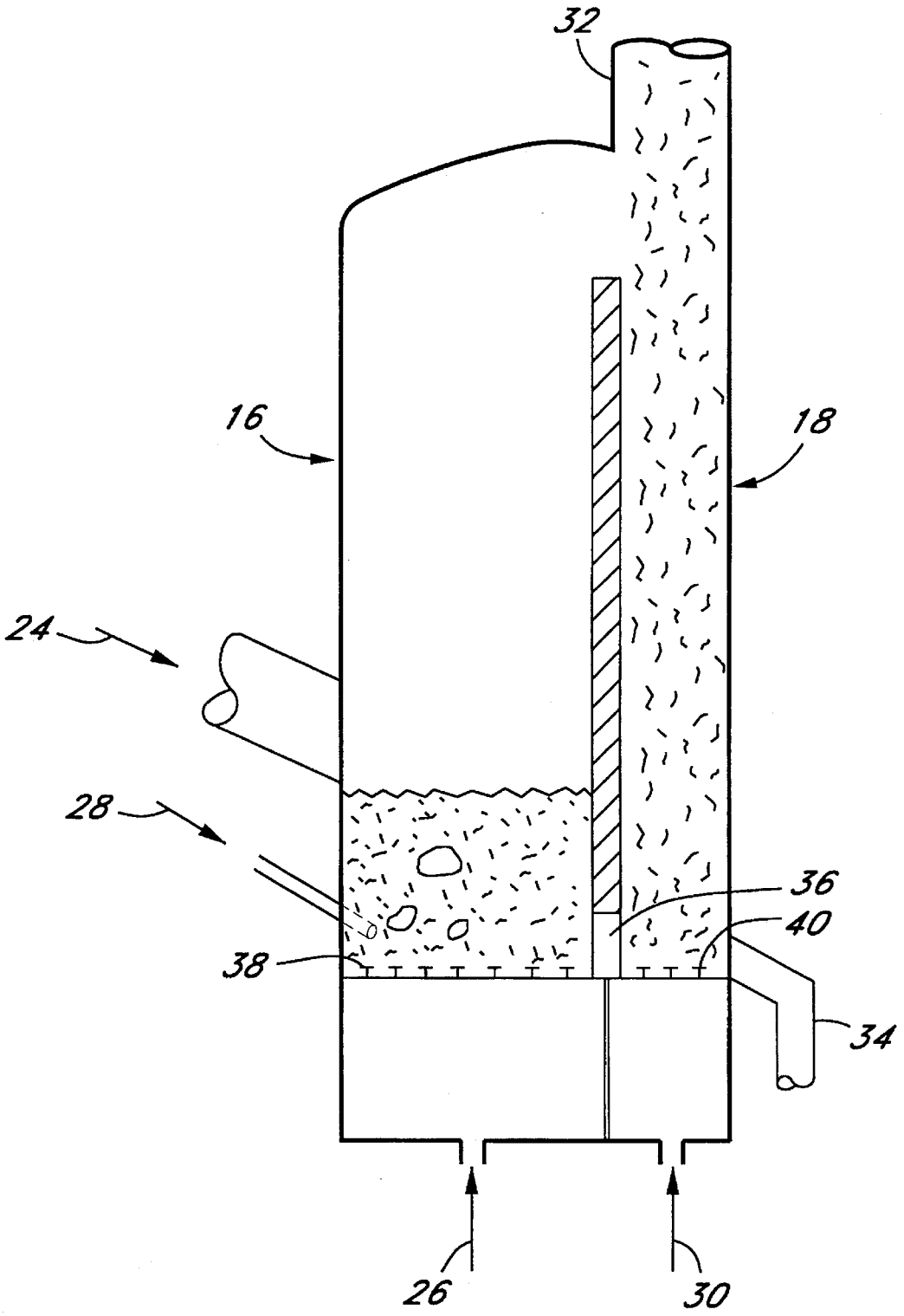
FIG. 2 is a schematic representation of a hydrator and classifier illustrated in FIG. 1.
Figure 7:
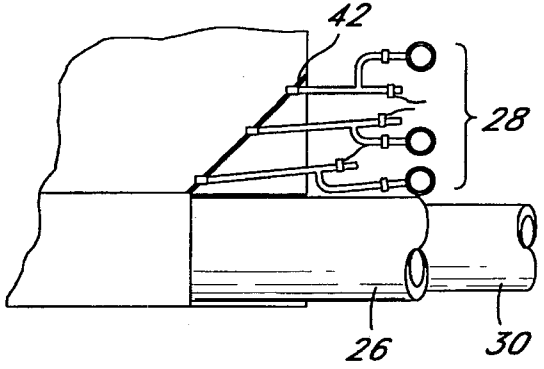
FIG. 7 is a detail drawing of the area enclosed by the dotted circle 7 shown in FIG. 6.
Figure 6:
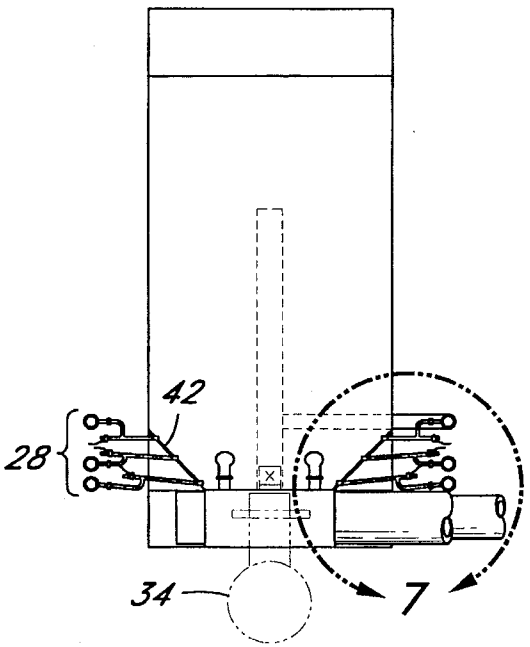
FIG. 6 is a front view of the hydrator of FIG. 4.

Referring to FIG. 2, the fluidized bed hydrator 16 receives, through line 24, the combustion residue from the combustor 12. The combustion residue is principally partially sulfated sorbent particles and fuel ash particles. The combustion residue is fluidized in the hydrator 16 by means of air introduced through a line 26 and can simultaneously be hydrated by the introduction of a hydration fluid, such as water and/or steam, through line 28 into the fluidized hydrator bed. Water may be added in the form of a spray, a mist from line 28, in the form of steam commingled with the air entering the hydrator 16 through the line 26, in the form of steam commingled with the line 28 spray or mist, or in any combination thereof.

The fluidized bed in the hydrator 16 allows mixing and contact of the combustion residue particles with the fluidizing medium. The use of a fluidized bed also helps to prevent formation of combustion residue agglomerates. During hydration of the partially sulfated sorbent particles in the hydrator 16, most of the calcium oxide inside the sorbent particles is hydrated to calcium hydroxide followed by decrepitation of the sorbent particles. The hydrator temperature can be controlled by appropriate adjustment of the mixture of steam/air from the inlet 26 and/or of the water and/or steam from the inlet 28.

Figure 5:
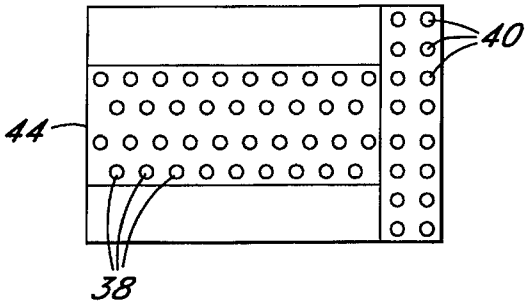
FIG. 5 is a drawing of the view taken along line 5—5 of FIG. 4.

Hydrated combustion residue can be passed from the hydrator 16 to the classifier 18 through the port 36, shown in FIG. 2. As shown best by FIG. 5, the steam and/or air provided by line 26 exits into the combustion residue through, for example, hydrator tuyers 38. Corresponding classifier tuyers 40 provide a fluidizing gas stream in the classifier 18. Tuyers 38 and 40 exit through a distributor grid plate 44.

The dry solid combustion residue leaves the combustor through conduit 24. The combustion residue comprises CaO, $CaSO_4$, and non-calcium solids. The combustion residue can be removed from the combustor at a flow rate $W_D$. The CaO concentration in the combustion residue will be $X_{CaO}$. Thus, The molar flow rate of the CaO, $M_{CaO}$ can be obtained as:

$$M_{CaO}=W_D\ X_{CaO}/56.08$$

Line 28 and/or line 26 can provide liquid water and/or water as steam to the hydrator. Where $W_{H2O}$ is the total quantity of water introduced, the water molar flow rate $M_{H2O}$ is:

$$M_{H2O}=W_{H2O}/18.016$$

A water to calcium oxide ratio ($H_2O$/CaO) can be defined as $M_{H2O}/M_{CaO}$. In theory, complete hydration without use or presence of any excess water can occur when this ratio is 1.0. In practice, due in part to sorbent particle geometry and apparatus design, 100% or complete hydration cannot be obtained and some excess water will be present. We have found that in excess of 95% of the calcium oxide present in the hydrator can be hydrated when the $M_{H2O}/M_{CaO}$ ratio is between about 1.2 and 4.5. The relationship between hydration efficiency and the $M_{H2O}/M_{CaO}$ ratio is complex and depends at least upon the initial calcium oxide concentration, sorbent particle size distribution and hydrator fluidized bed temperature.

In the hydrator 16, at least about 90% to about 95% of the CaO can converted to $Ca(OH)_2$ by practicing the disclosed method. Most of the sorbent particles to be hydrated comprise a $CaSO_4$ shell surrounding a CaO core. Upon hydration, these particles crack open, the $CaSO_4$ shell peels off, and the remaining CaO becomes very friable. Due to the agitation provided by the fluidized bed of the hydrator, the CaO particles break down until most are less than about 100 microns in diameter. Typically, at least about 95% of the sorbent particles transported from the combustor are larger than about 100 microns. Non-sorbent particles, such as fuel ash, are essentially unaffected by the hydration process.

In the classifier 18, the finer sorbent particles created in the hydrator, can be stripped from the coarser non-sorbent particles by fluidizing at a velocity that is above the terminal velocity of the sorbent fines but below the terminal velocity of the coarser non-sorbent particles.

Through conduit 32, the sorbent portion can be returned pneumatically to the combustor. The sorbent portion will usually entrain a small amount of fuel ash, comprising about 5% by weight of the sorbent portion. Thus, the stream returned to the combustor can include the air used to fluidize the hydrator and the classifier beds, excess water evaporated from the hydrator, $Ca(OH)_2$ fines, $CaSO_4$ fines, unhydrated CaO, and fuel ash.

The coarser, non-sorbent portion can be extracted from the bottom of the classifier by gravity flow through the bottom drain and conduit 34. This non-sorbent portion can be about 95% by weight fuel ash and includes some $CaSO_4$, and a small amount of unhydrated CaO. The present method and system can be practiced to achieve a 95% hydration efficiency, whereby about one half of the remaining unhydrated sorbent particles are returned to the combustor and the other half removed with the waste at conduit 34. Thus, the present method permits about 97.5% by weight (95% $Ca(OH)_2$, 2.5% CaO) of the sorbent particles removed from the combustor to be recycled back to the combustor.

The concentration of CaO in the final waste stream can depend upon the proportion of fuel ash to sorbent in the combustor bed, and the extent of sulfation of the sorbent removed from the combustor to the hydrator.

When the sorbent particles are hydrated, heat is released causing the sorbent particles to swell, crack and fragment. This process is enhanced by the impact of the sorbent particles with one another in the fluidized bed of the hydrator and results in the exposure of free lime within the partially sulfated sorbent particle and reduction in sorbent particle size.

Preferably, combustion residue removed from the fluidized bed combustor 12 remains resident in the hydrator 16 for between about 5 minutes and about 20 minutes in the presence of a water/steam mixture to permit the majority of the sorbent particles to be hydrated. Generally, the lower the temperature of the fluidized bed in the hydrator, the faster the hydration reaction can proceed.

A residence time of the combustion residue in the hydrator 16 of less than about five minutes is not preferred because the majority of the sorbent particles will not thereby become hydrated. A residence time of the combustion residue particles in the hydrator 16 of more than about twenty minutes does not lead to significant additional sorbent particle hydration.

More preferably, the combustion residue is present in the fluidized bed hydrator for about ten minutes to about fifteen minutes which we have found to be a sufficient time for essentially complete hydration of sorbent particles to occur.

Preferably, the hydrator 16 is operated so that the average hydrator bed temperature during the period of combustion residue residence in the hydrator is between about 215° F. and about 450° F. Below about 215° F. excess water cannot be evaporated from the hydrator bed particles. Above about 450° F. the hydration process proceeds at a very slow rate. Generally, the hydration reaction proceeds faster at a lower temperature.

More preferably, the hydrator bed temperature is maintained at a temperature of between about 218° F. and about 350° F. during the period of sorbent particle residence in the hydrator 16. Within this temperature range excess water can be readily evaporated from the hydrator bed and the hydration reaction process at an acceptable rate, permitting a brief combustion residue residence time in the hydrator.

Most preferably, the hydrator bed temperature is maintained at a temperature of between about 218° F. and about 250° F. because we have found this temperature range to be optimal for high sorbent hydration combined with low excess moisture retention by the combustion residue.

The combustion residue in the hydrator 16 is fluidized to ensure mixing of the water with the sorbent particles. We have found that the fluidizing velocity in the hydrator is best maintained at a velocity of between about 2 feet/second and about 7 feet per second. A gas stream entering the hydrator 16 at a velocity of less than about 2 feet/second may not fluidize the hydrator bed. A fluidizing velocity in the hydrator 16 of more than about 7 feet/second can cause sorbent particles to become entrained in the gas stream before they have become hydrated.

More preferably, the fluidizing velocity in the hydrator 16 is maintained at a velocity of between about 3 feet/second and about 5 feet/second to achieve an optimal fluidization of hydrator bed particles.

Figure 4:
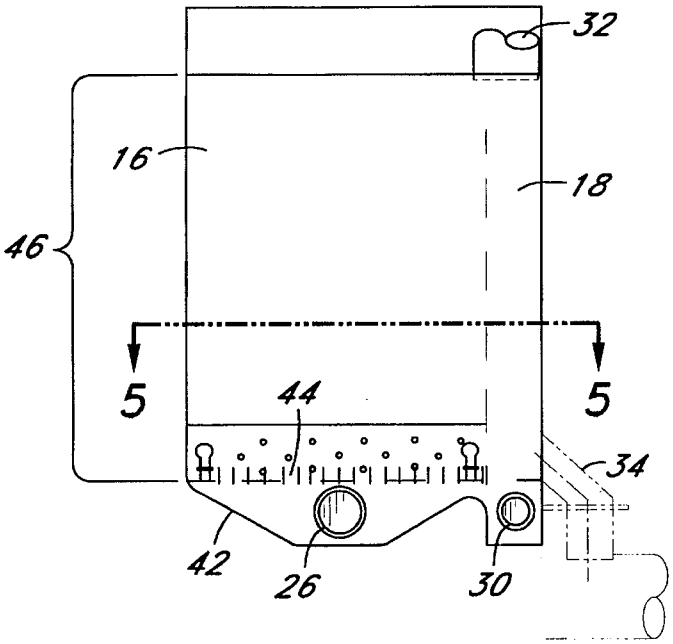
FIG. 4 is a schematic representation of a side view of another embodiment of a hydrator within the scope of the present invention.

A preferred embodiment of the hydrator 16 has both water/steam injection lines 28 and air/steam injection lines 26. In a most preferred embodiment, as shown by FIG. 4, the hydrator 16 can have a tapered bottom 42 so that vigorous air fluidization can be accomplished at the bottom of the hydrator vessel. Vigorous fluidization can: (1) keep the combustion residue solids moving so that any tramp water that finds its way to the bottom of the hydrator can be scrubbed by the moving solids; and (2) assist in breaking up any wet agglomerates that may form in the wider hydrator section above the tapered hydrator bottom. The wider hydrator upper section allows the bulk of the combustion residue bed to be fluidized in the hydrator at a lower fluidization velocity, thereby reducing entrainment of material in the air stream above the fluidized bed. The indicated dual hydrator air velocity is due to the tapering of the lower or bottom hydrator section 42. The air velocity is about twice as high in the upper and larger untapered section 46 as it is in the lower and smaller area of the bottom tapered section 42. Preferably the taper or angle of the lower hydrator section 42 is between about 45° and about 75° from the horizontal, depending upon space availability and the placement of air, water and steam injectors. More preferably, the angle from the horizontal of the lower hydrator section 42 is between about 50° and about 60° to achieve optimal fluidization and contact with water and/or steam.

The combustion residue, including the hydrated sorbent particles can exit the hydrator 16 through an underflow port to the classifier 18. In the classifier 18, the combustion residue is fluidized by means of air entering through a line 30. The fluidizing velocity of the air or other gas in the classifier 18 causes the finer sorbent particles to become separated from the coarser fuel ash particles, which fall to the bottom of the classifier vessel. The coarser particles are primarily non-sorbent particles and are removed from the classifier via an outlet line 34.

Preferably, the gas fed into the classifier 18 has a fluidizing velocity of between about 4 feet/second and about 10 feet per second. We have found that the hydrated sorbent particles are entrained within the air stream returning to the combustor when this air stream is maintained at a velocity equal to or greater than about 4 feet/second. Additionally, we have found that the coarser fuel ash particles will not be entrained within the air stream returning to the combustor when this air stream is maintained at a velocity equal to or less than about 10 feet/second. Thus, less than 4 feet/second provides deficient stripping of sorbent out of the combustion residue, and greater than about 10 feet/second lifts fuel ash into the air stream.

More preferably, the fluidizing velocity in the classifier 18 is maintained at a velocity of between about 6 feet/second and about 8 feet per second.

After separation from the non-sorbent particles, the hydrated sorbent particles can be recycled in the fluidized-bed combustor 12 via line 32. Alternately, the hydrated sorbent can be commingled with virgin limestone introduced into the combustor 12. The air exiting the fluidized hydrator and classifier beds can be used as a dilute pneumatic transport to reinject the hydrated, and concentrated sorbent particles back into the combustor, for example as part of the combustor secondary air supply.

The hydrator 16 and the classifier 18 can be combined where a high sulfur, low-ash fuel, such as coal, is burned. In such a circumstance, the sorbent particles can comprise the majority of the combustion residue particles. The combined hydrator/classifier can have a fluidizing and classifying gas velocity of between about 4 feet/second and about 10 feet/second. As previously, the coarser ash particles can be removed from a bottom drain.

Figure 3:
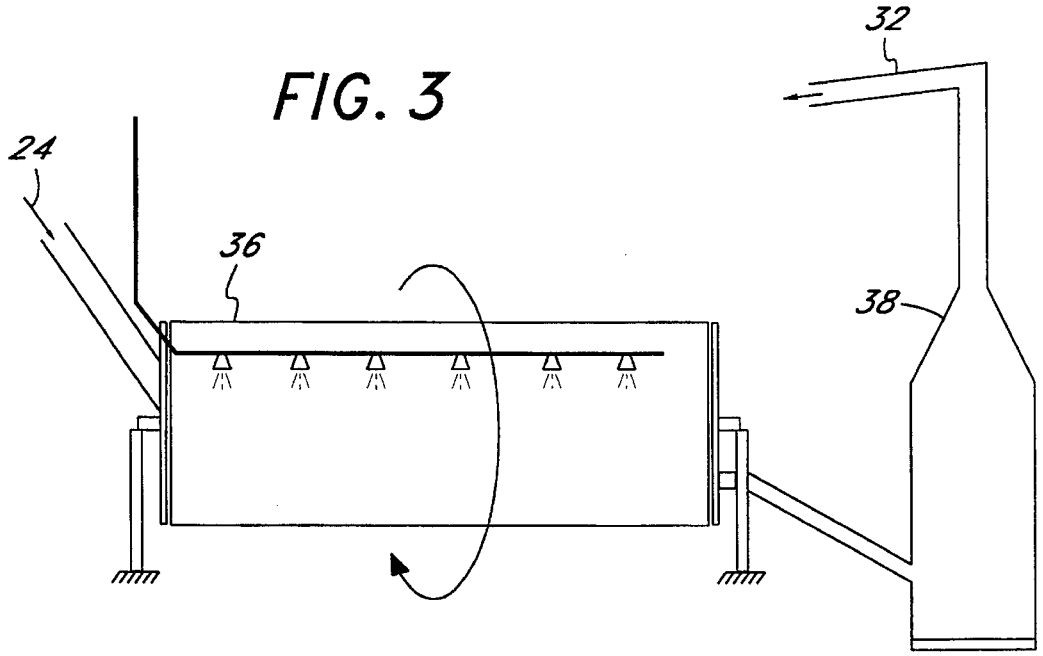
FIG. 3 is a schematic representation of another embodiment of a hydrator and classifier within the scope of the present invention.

A mechanical hydrator can be used instead of a fluidized bed hydrator. FIG. 3 shows a mechanical rotary hydrator 36 within the scope of the present invention. The solid inventory in this hydrator, the amount of water spray and the hydrator rotation speed are determined to obtain maximum conversion and decrepitation of sorbent particles.

From the rotary hydrator 48, the hydrated sorbent can be passed to an air fluidized classifier 50 for selective return the finer hydrated particles to the combustor 12.

The foregoing is a description of a method and system for practicing the present invention and particularly discloses a continuous process in which hydrated sorbent particles can be recycled in a fluidized-bed combustor.

EXAMPLES

The following examples set forth illustrations of various features and embodiments of the invention and are not intended to limit the scope of the claimed invention.

Example 1

Hydration of A Sample of Fluidized Bed Combustor Sorbent

An experiment was carried out to determine the time period for essentially complete hydration of spent sulfur sorbent.

A sample of bottom ash was removed from the bed ash cooler of a fluidized bed combustor. A thermocouple was inserted into the sample and temperature recorded as a function of time. Water was poured onto the sample in the container. Sufficient water was used to ensure that the sample remained wet after completion of the test. The thermocouple recorded a temperature increase, indicating the exothermic hydration reaction. The sample was subsequently agitated. It was determined that the hydration reaction of sorbent present in the ash sample was essentially complete in about 10 minutes.

Figure 8:
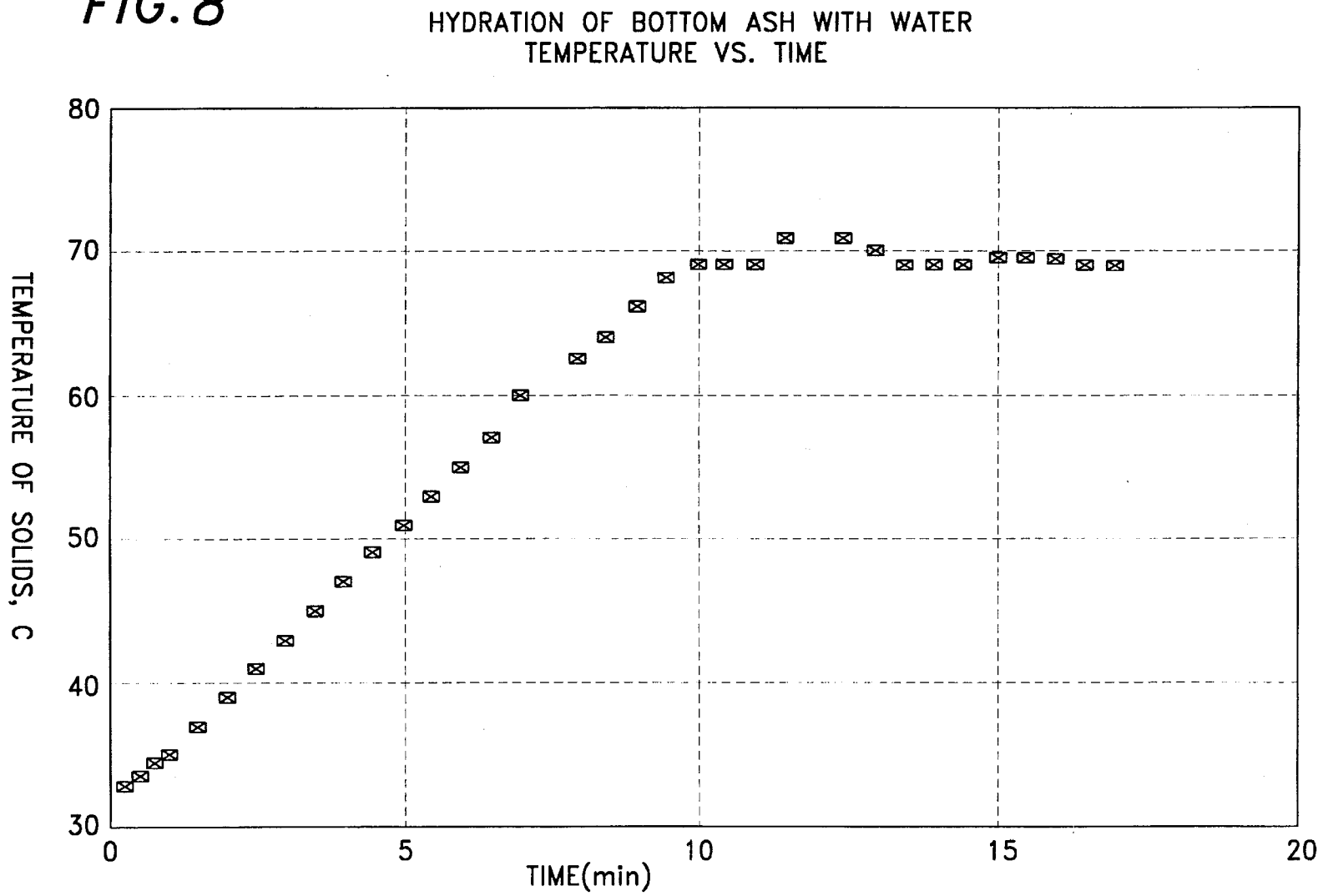
FIG. 8 is a graphical representation of temperature in degrees Celsius versus time in minutes for a fluidized bed combustor bottom ash hydration experiment.

The results of this experiment are set forth by the attached FIG. 8 which shows a graphical representation of temperature in degrees Celsius (on the vertical axis) versus time in minutes (on the horizontal axis) for a fluidized bed combustor bottom ash hydration experiment, without stirring the bottom ash sample.

Example 2

Prototype Fluidized Bed Hydrator Operating Results

A prototype fluidized bed hydrator was constructed and used to hydrate various samples of fluidized bed combustor bottom ash. The prototype was a single cell device without a separate classifier. Steam and/or air was introduced through a bottom hydrator grid. Bottom ash samples from the Example 1 combustor were used. The bottom ash sample was evenly distributed over the hydrator grid.

Table 1 shows the results of this experiment. "Excess moisture, %" refers to the fraction of the sample weight after testing that was moisture. As shown by Table 1, lower temperatures resulted in incomplete sample drying, while at higher temperatures the percentage by weight of hydrated calcium oxide decreased.

The fluidizing velocities shown in Table 1 were reduced where a two cell hydrator/classifier system was used. For a hydrator/classifier system an optimal hydrator fluidizing velocity range was about 3–5 feet/second.

The hydrated sorbent obtained by practicing the present method has a markedly increased sulfation capacity. Table 2 shows under the column heading "CFB Sorbent Utilization" the percentage of sorbent by weight from the bottom ash of the circulating fluid bed boiler which has been transformed from Ca to $CaSO_4$, where the sorbent had not been hydrated. Thus, the "CFB Sorbent Utilization" column shows the fraction of sorbent which had become sulfated. Under the Table 2 column headed "CFB + TGA Utilization, %" there is shown the fraction of sorbent by weight which had become sulfated after further sulfation a TGA test, but without subjecting the sorbent to hydration. The Table 2 column headed "CFB + Hydration+TGA Utilization, %" data was obtained by hydrating the sorbent prior to the carrying out the TGA sulfation test.

TGA is an abbreviation for thermogravimetric analysis. TGA is a method used to determine the amount of sulfur capture that can be attained by a sorbent sample in a circulating fluidized bed boiler (CFB) and requires recording the weight of a sorbent sample during calcination and sulfation conditions. We carried out TGA testing by standardizing the TGA test procedures and holding them constant during the test. Details regarding the TGA method used can be found in the paper by Edvardsson, C. M., and Alliston, M. G., entitled *Thermogravimetric Analysis of Limestones For Prediction Of Utilization In CFB Combustors*, presented at the Environmental Aspects of Cogeneration conference organized by the Air & Waste Management Association, Nov. 10–12, 1992, Pittsburgh, Pa., which paper is incorporated herein by reference in its entirety.

This experiment demonstrated that:

a. the hydration reaction time for sorbent in the fluidized combustion residue bed was similar to the time required to hydrate bulk bottom ash with water—as set forth by Example 1 above.

b. the hydration reaction time was shorter when the bulk solids temperature was maintained at a lower average temperature.

c. it was visually observed that hydration of sorbent present in the fluidized hydrator bed generated fine white particles, as compared to the coarse yellow particles of which the initial bottom ash was comprised.

d. sulfation thermogravimetric analysis performed on the bottom ash before and after fluidized bed hydration showed a dramatic increase in sulfation reactiveness, as shown by Table 2.

Example 3

A System For Recycling Sorbent

An existing circulating fluidized bed pilot plant was used for testing a hydrator/classifier system. The fuel and sorbent used in the pilot CFB, as well as flow rates, without the hydrator on line, are shown by Table 3.

The hydrator/classifier system for recycling spent sulfur sorbent to the fluidized bed combustor was attached to the bottom ash outlet of the CFB combustor. This system was a two chamber device with a fluidized bed hydrator chamber and a fluidized bed classifier chamber. The hydrator chamber was fed a stream of combustion residue, as received by gravity flow from the bottom ash outlet of the fluidized bed combustor.

The hydrator chamber of the system was fitted with air and steam lines able to supply water, air and/or steam. The classifier was fitted with air supply lines.

The CFB pilot plant was run first without the hydrator in operation. Another test with otherwise identical operating parameters was run with the hydrator in operation. When the hydrator was brought on line, the sulfur dioxide emission dropped from about 300 ppm to about 60 ppm. The limestone feed rate, which was automatically controlled by a $SO_2$ emission setpoint monitor, dropped from about 230 lb/hr to about 60 lb/hr in twenty minutes, and then dropped to about 0 lb/hr after about ten more minutes of operation. After about thirty minutes of further pilot CFB operation, the limestone feed rate gradually started to increase because the amount of lime in the combustor's bottom ash stream (and therefore the amount of hydrated lime being recycled) was decreasing. The limestone feedrate did not return to its original 230 lb/hr rate until after operation of the hydrator has ceased.

A method and system according to the invention disclosed herein has many advantages, including the following:

1. sorbent with an increased sulfation capacity can be prepared and recycled in a combustor.
2. the classifier permits sorbent particles with an increased sulfation capacity to be simply and efficiently returned to the fluidized bed combustor.
3. coarser sorbent particles can be used in the combustor with the result of a significantly increased sorbent sulfation utilization capacity. Additionally, use of a coarser sorbent material can simplify the crusher or mill equipment required and reduce auxiliary power consumption used to grind the limestone sorbent.
4. much lower sulfur dioxide emission levels can be achieved with the same amount of sorbent material. Thus, the amount of limestone required for sulfur capture can be reduced because the free lime occluded in sorbent particles by an initial sulfation reaction is exposed and reintroduced into the combustor for further sulfation of the recycled sorbent particles.
5. a lower total sorbent concentration in the combustor bed material can be maintained. This in turn results in a lower concentration of free lime in the combustor. Since free lime can act as a catalyst in the oxidation of fuel nitrogen to nitrous and nitric oxides ($NO_x$), the emission of $NO_x$ substances is reduced.
6. the load on the ash handling system is reduced because less sorbent is required.
7. the combustion, including the fuel ash becomes less alkaline because the sorbent becomes sulfated to a higher extent.

Although the present invention has been described in detail with regard to certain preferred methods, other embodiments, versions, and modifications within the scope of the present invention are possible. For example, a wide variety of classifier designs are possible, including combined hydrator/classifier designs.

Accordingly, the spirit and scope of the following claims should not be limited to the descriptions of the preferred embodiments set forth above.

TABLE 1

Results of Prototype Fluidized Bed Hydrator Tests

| Run # | Fluidized Bed Temperature, F | Residence Time, min. | Fluidizing Velocity, Ft/s | % Steam in Fluidizing Gas | % of CaO Hydrated | Excess Moisture, % |
|---|---|---|---|---|---|---|
| 1 | 215–216 | 10 | 6 | 100 | 100.0 | 11.2 |
| 2 | 218–250 | 12 | 6 | 100 | 100.0 | 1 |
| 3 | 216–229 | 5 | 6 | 100 | 85.0 | 1.2 |
| 4 | 188–318 | 12 | 6.5 | 50 | 84.0 | 3.7 |
| 5 | 233–291 | 12 | 6.5 | 100 | 64.0 | 0 |

TABLE 2

Results of Sorbent Sulfation Tests by Thermogravimetric Analysis (TGA)

| Sample # | CFB Sorbent Utilization | CFB + TGA Utilization, % | CFB + Hydration + TGA Utilization, % |
|---|---|---|---|
| 1 | 31 | 53 | 98 |
| 2 | 31 | 53 | 90 |

TABLE 3

Pilot Plant Testing Feedstocks

| | % Weight | | % Weight |
|---|---|---|---|
| Fuel: Bituminous Gob | | Limestone | |
| Carbon | 44.41 | Calcium Carbonate | 88.83 |
| Hydrogen | 2.79 | | |
| Nitrogen | 0.82 | Magnesium Carbonate | 1.68 |
| Oxygen | 3.97 | | |
| Sulfur | 3.40 | Moisture | 0.19 |
| Moisture | 1.19 | Other | 9.3 |
| Ash | 43.42 | | |
| HHV | 7662 BTU/lb | | |
| Average Test Flow Rate | 1107 | Average Test Flow Rate | 220 |

We claim:

1. A method for recycling sorbent particles in a fluidized bed, fossil-fuel combustor, comprising the steps of:

(a) removing a combustion residue from a fluidized bed fossil-fuel combustor, the combustion residue comprising sorbent particles and non-sorbent particles;

(b) transporting the combustion residue to a hydrator;

(c) hydrating the sorbent particles by contacting the combustion residue in the hydrator with a hydration fluid;

(d) conveying the combustion residue to a classifier;

(e) classifying the combustion residue in the classifier into a portion comprising principally the sorbent particles and a portion comprising principally the non-sorbent particles, wherein classifying is carried out by fluidizing the combustion residue present in the classifier; and (f) returning the portion comprising principally the sorbent particles to the fluidized bed fossil-fuel combustor.

2. The method of claim 1, wherein the classified portion comprising principally the sorbent particles comprises not more than about 20% by weight non-sorbent particles.

3. The method of claim 1, wherein the classified portion comprising principally the sorbent particles comprises not more than about 10% by weight non-sorbent particles.

4. The method of claim 1, wherein the classified portion comprising principally the sorbent particles comprises not more than about 5% by weight non-sorbent particles.

5. The method of claim 1, wherein the classified portion comprising principally the sorbent particles comprises not more than about 2.5% by weight non-sorbent particles.

6. The method of claim 1, wherein at least about 80% by weight of the classified portion comprising principally the sorbent particles comprises hydrated sorbent particles.

7. The method of claim 1, wherein at least about 90% by weight of the classified portion comprising principally the sorbent particles comprises hydrated sorbent particles.

8. The method of claim 1, wherein at least about 95% by weight of the classified portion comprising principally the sorbent particles comprises hydrated sorbent particles.

9. The method of claim 1, wherein at least about 97% by weight of the classified portion comprising principally the sorbent particles comprises hydrated sorbent particles.

10. The method of claim 1, wherein subsequent to the transporting step and prior to the classifying step, the combustion residue is resident in the hydrator for a period of time of between about 5 minutes and about 20 minutes.

11. The method of claim 10, wherein the combustion residue is resident in the hydrator for a period of time of between about 10 minutes and about 15 minutes.

12. The method of claim 1, further comprising the step of fluidizing the combustion residue resident in the hydrator.

13. The method of claim 12, wherein the combustion residue resident in the hydrator is fluidized by subjecting the combustion residue to a gas stream maintained at a fluidizing velocity.

14. The method of claim 13, wherein the fluidizing velocity of the gas is between about 2 feet/second and about 7 feet/second.

15. The method of claim 14, wherein the fluidizing velocity of the gas is between about 3 feet/second and about 5 feet/second.

16. The method of claim 1, wherein during the hydrating step, the combustion residue is maintained at an average temperature of between about 215° F. and about 450° F.

17. The method of claim 16, wherein the combustion residue is maintained at an average temperature of between about 218° F. and about 350° F.

18. The method of claim 17, wherein the combustion residue is maintained at an average temperature of between about 218° F. and about 250° F.

19. The method of claim 1, wherein the combustion residue present in the classifier is fluidized by subjecting the combustion residue to a gas projected into the classifier at a fluidizing velocity.

20. The method of claim 19, wherein the fluidizing velocity of the gas is between about 4 feet/second and about 10 feet/second.

21. The method of claim 1, wherein the classified portion comprising principally the sorbent particles comprises not more than about 20% by weight non-sorbent particles.

22. The method of claim 1, wherein at least about 80% by weight of the classified portion comprising principally the sorbent particles comprises hydrated sorbent particles.

23. The method of claim 1, further comprising the step of repeating steps (a) to (f) to thereby obtain a continuous recycling of the sorbent in the fluidized bed combustor.

24. The method of claim 1, further comprising the step of disposing to waste of the portion comprising principally the fuel ash particles.

25. A method for recycling sulfur sorbent particles in a fluidized bed fossil-fuel combustor, comprising the steps of:

(a) removing a combustion residue from a fluidized bed fossil-fuel combustor, the combustion residue comprising sorbent particles and non-sorbent particles;

(b) transporting the combustion residue to a hydrator;

(c) fluidizing the combustion residue resident in the hydrator by subjecting the combustion residue to a gas maintained at a fluidizing velocity of between about 2 feet/second and about 7 feet/second;

(d) hydrating the sorbent particles present in the combustion residue by contacting the combustion residue with water and/or steam;

(i) for a period of time of between about 5 minutes and about 20 minutes, and (ii) while maintaining the combustion residue at a temperature of between about 215° F. and about 450° F., thereby obtaining hydrated sorbent particles with an increased sulfation capacity;

(e) conveying the combustion residue to a classifier;

(f) classifying the combustion residue present in the classifier into a portion comprising principally sorbent particles and a portion comprising principally non-sorbent particles by fluidizing the combustion residue present in the classifier by subjecting the combustion residue to a gas maintained at a fluidizing velocity of between about 4 feet/second and about 10 feet/second, wherein the classified portion comprising principally the sorbent particles comprises;

(i) not more than about 20% by weight non-sorbent particles and, (ii) at least about 80% by weight of the sorbent particles present in the classified portion comprises hydrated sorbent particles; and (g) returning the classified portion comprising principally the sorbent particles to the fluidized bed fossil-fuel combustor.

26. A system for improving the sulfation capacity and use in a fossil-fuel combustor of sorbent particles, comprising:

(a) apparatus for removing a combustion residue from a fossil-fuel combustor and transporting it to a hydrator, the combustion residue comprising sorbent particles and non-sorbent particles;

(b) a hydrator for hydrating the sorbent particles present in the combustion residue;

(c) a classifier for classifying the combustion residue into a portion comprising principally the sorbent particles and a portion comprising principally the non-sorbent particles by fluidizing the combustion residue present in the classifier; and (d) apparatus for returning the classified portion comprising substantially all the sorbent particles to the fossil-fuel combustor.

27. The system of claim 26, wherein the hydrator is a fluidized bed hydrator.

28. The system of claim 27, wherein the combustor is a fluidized bed combustor.

29. The system of claim 26, wherein the classifier is a fluidized bed classifier.

30. The system of claim 26, wherein the classified portion comprising substantially all the sorbent particles is comprised principally of hydrated sorbent particles.

31. The system of claim 27, wherein the fluidized bed of the hydrator is maintained at a temperature of between about 215° F. and about 450° F.

32. The system of claim 27, wherein the fluidized bed of the hydrator is fluidized by a gas stream maintained at a fluidizing velocity of between about between 2 feet/second and about 7 feet/second.

33. The system of claim 27, wherein the hydrator has a tapered bottom section.

34. The system of claim 29, wherein the fluidized bed of the classifier is fluidized by a gas stream maintained at a fluidizing velocity of between about 4 feet/second and about 10 feet/second.

35. A system for recycling sulfur sorbent particles in a circulating, fluidized bed, fossil-fuel combustor, comprising:

(a) apparatus for removing a combustion residue from a circulating, fluidized bed, fossil-fuel combustor, the combustion residue comprising sulfur sorbent particles and non-sorbent particles;

(b) apparatus for fluidizing the combustion residue by subjecting the combustion residue to a gas maintained at a fluidizing velocity of between about 2 feet/second and about 7 feet/second;

(c) apparatus for contacting the combustion residue with water and/or steam to hydrate the sulfur sorbent particles;

(i) for a period of time of between about 5 minutes and about 20 minutes, and (ii) while maintaining the combustion residue at a temperature of between about 215° F. and about 450° F., thereby obtaining hydrated sulfur sorbent particles with an increased sulfation capacity;

(d) apparatus for classifying the combustion residue into a portion comprising principally the hydrated sorbent particles and a portion comprising principally the non-sorbent particles by fluidizing the combustion residue by subjecting the combustion residue it to a gas maintained at a fluidizing velocity of between about 4 feet/second and about 10 feet/second; and (e) apparatus for returning the portion comprising principally the hydrated sorbent particles to the circulating, fluidized bed, fossil-fuel combustor.

* * * * *